United States Patent [19]

Hirano

[11] Patent Number: 4,499,866

[45] Date of Patent: Feb. 19, 1985

[54] CYLINDER HEAD FOR INTERNAL COMBUSTION ENGINE

[75] Inventor: Yoshinori Hirano, Yokohama, Japan

[73] Assignee: Nissan Motor Company, Limited, Yokohama, Japan

[21] Appl. No.: 580,424

[22] Filed: Feb. 15, 1984

[30] Foreign Application Priority Data

Feb. 17, 1983 [JP] Japan ..... 58-21990[U]

[51] Int. Cl.[3] ..... F01P 3/02; F01P 3/22

[52] U.S. Cl. ..... 123/41.21; 123/41.74; 123/41.82 R

[58] Field of Search ..... 123/41.2, 41.21, 41.26, 123/41.72, 41.74, 41.79, 41.82 R

[56] References Cited

U.S. PATENT DOCUMENTS

| | | | |
|---|---|---|---|
| 1,704,951 | 3/1929 | Rudkin | 123/41.2 |
| 1,712,464 | 5/1929 | Woolson | 123/41.2 |
| 2,121,015 | 6/1938 | Campbell | 123/41.2 |
| 2,844,129 | 7/1958 | Beck et al. | 123/41.21 |
| 3,256,868 | 5/1964 | Gratzmuller | 123/41.44 |
| 3,384,304 | 4/1967 | Barlow | 237/8 |
| 3,448,729 | 6/1969 | Parsons | 123/41.2 |
| 3,524,499 | 9/1968 | Senf | 165/110 |
| 3,731,660 | 5/1973 | Leffert | 123/41.42 |
| 4,284,037 | 8/1981 | Kasting et al. | 123/41.72 |

FOREIGN PATENT DOCUMENTS

| | | | |
|---|---|---|---|
| 0059423 | 9/1982 | European Pat. Off. . | |
| 600372 | 7/1934 | Fed. Rep. of Germany . | |
| 713500 | 10/1941 | Fed. Rep. of Germany . | |
| 8686 | 5/1951 | Fed. Rep. of Germany . | |
| 1155635 | 10/1963 | Fed. Rep. of Germany . | |
| 1214935 | 4/1966 | Fed. Rep. of Germany . | |
| 57-143120 | 9/1982 | Japan | 123/41.72 |
| 58-104344 | 6/1983 | Japan | 123/41.72 |
| 428261 | 4/1935 | United Kingdom . | |
| 693873 | 7/1953 | United Kingdom . | |

*Primary Examiner*—William A. Cuchlinski, Jr.

*Attorney, Agent, or Firm*—Schwartz, Jeffery, Schwaab, Mack, Blumenthal & Koch

[57] ABSTRACT

In order to prevent dry spots being produced by abnormally large amounts of coolant suddenly being discharged in the form of a boiling froth or foam, from the coolant jacket of an engine wherein the coolant is introduced in a liquid form, boiled and discharged in gaseous form, the cylinder head is arranged with a coolant jacket structure wherein gaseous coolant and/or coolant foam is accumulated in a relatively large space and subsequently discharged upwardly through a plurality of ports and thereafter undergo multiple deflections and changes of direction in a manifold which includes an "expansion" chamber. This induces any liquid coolant to separate from the gaseous coolant and to flow back toward the structure defining the combustion chamber and coolant jacket formed in the cylinder head. Further, cool liquid coolant (from the heat exchanger) is introduced into the cylinder head coolant jacket in a zone of high heat flux.

5 Claims, 10 Drawing Figures

CYLINDER HEAD FOR INTERNAL COMBUSTION ENGINE

BACKGROUND OF THE INVENTION

1. Field of the Invention

The present invention relates generally to an internal combustion engine and more specifically to an improved cylinder head for an internal combustion engine wherein coolant is introduced thereinto in liquid form and exhausted to a heat exchanger in a gaseous form.

2. Description of the Prior Art

European Patent Application No. 0 059 423 published on Sept. 8, 1982 discloses an arrangement wherein, as schematically shown in FIG. 1 of the drawings, liquid coolant in the coolant jacket of the engine 1, is not circulated therein and permitted to absorb heat to the point of boiling. The gaseous coolant is adiabatically compressed in a compressor 3 so as to raise the temperature and pressure thereof and introduced into a heat exchanger 4. After condensing, the coolant is temporarily stored in a reservoir 5 and recycled back into the coolant jacket via flow control valve 6.

However, this arrangement has suffered from a drawback in that the coolant in the coolant jacket 7 (see FIG. 2) upon boiling, occasionally tends to form large gas bubbles which displaces the coolant out of the cylinder head 8 in the form of a boiling froth or foam which is subsequently inducted into the compressor 3. This induces a sudden removal of coolant from the coolant jacket 7 and tends to permit localized dry spots to form therein. These spots, due to the temporary lack of coolant become excessively heated and further promote the "dry-out" phenomenon. This problem is particularly prevalent in zones of high heat flux such as in the vicinity of the exhaust valve seat and tends to induce engine knocking and/or thermal damage.

SUMMARY OF THE INVENTION

It is an object of the present invention to provide a cylinder head arrangement for an internal combustion engine wherein cooling is achieved by "boiling off" the coolant, which obviates the tendancy for dry spots to occur within the coolant jacket of the engine.

In brief, this object is achieved by providing the cylinder head with a coolant jacket wherein gaseous coolant and/or coolant foam accumulates in a relatively large space and subsequently discharged upwardly through a plurality of relatively small ports and thereafter undergo multiple deflections and changes of direction in a collection manifold which includes an "expansion" chamber. This induces any liquid coolant to separate from the gaseous coolant and to flow back toward the structure defining the combustion chamber and the coolant jacket formed in the cylinder head. Further, cool liquid coolant (recycled from the heat exchanger) is introduced into the cylinder head coolant jacket in a zone of high heat flux.

More specifically, the present invention takes the form of an internal combustion engine which features: a cylinder block including a coolant jacket into which coolant is introduced in liquid form and discharged in gaseous form, a cylinder head removably attached to the cylinder block, the cylinder head including a structure which defines one or more combustion chambers and a coolant jacket, the coolant jacket including: a first port which fluidly communicates with the cylinder block coolant jacket, a chamber defined above the structure defining the one or more combustion chambers and the first port, the chamber being arranged to be filled with liquid coolant to a level which immerses the one or more combustion chamber defining structure, and a plurality of second ports which fluidly communicate with said chamber and through which gaseous coolant is discharged, the second ports being arranged at a level above that of the chamber and arranged to have a cross section which limits the discharge of liquid coolant from the chamber.

BRIEF DESCRIPTION OF THE DRAWINGS

The features and advantages of the arrangement of the present invention will become more clearly appreciated from the following description taken in conjunction with the accompanying drawings in which.

DESCRIPTION OF THE PREFERRED EMBODIMENTS

Figure 1:
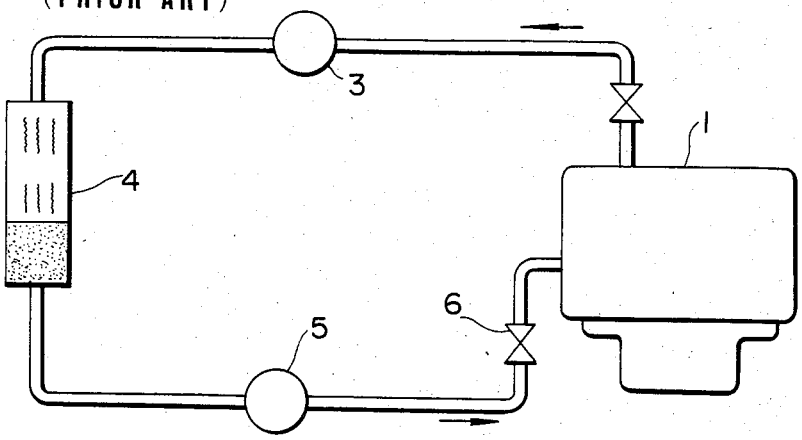
FIG.1 (PRIOR ART)
FIGS. 1 and 2 shows the prior art engine arrangement discussed briefly in the opening paragraphs of the present invention.
Figure 2:
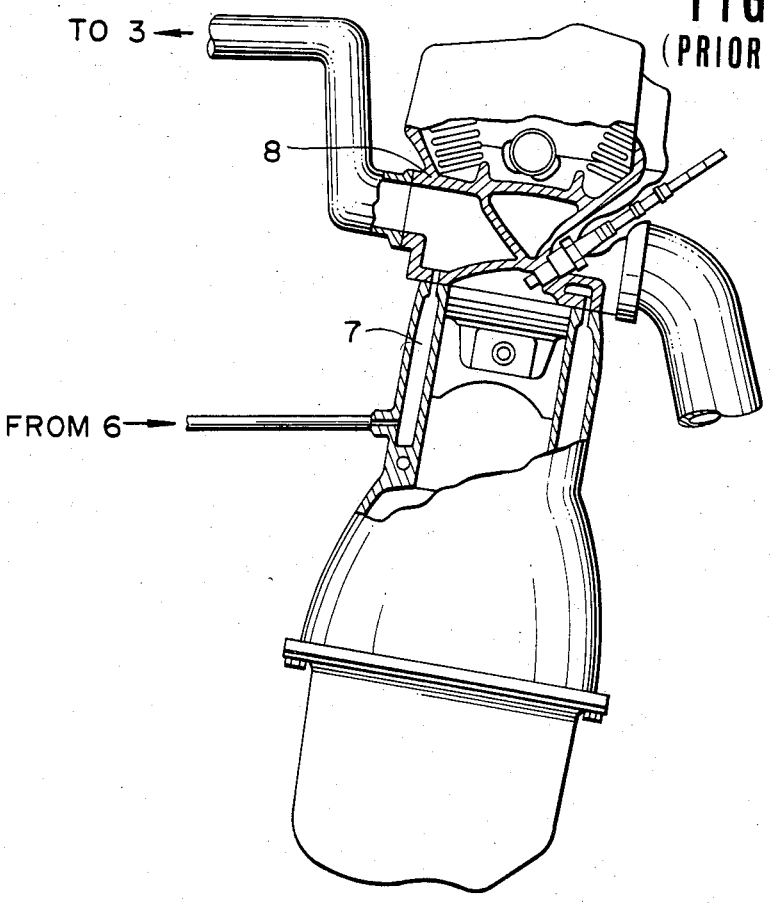
FIG.2 (PRIOR ART)
Figure 3:
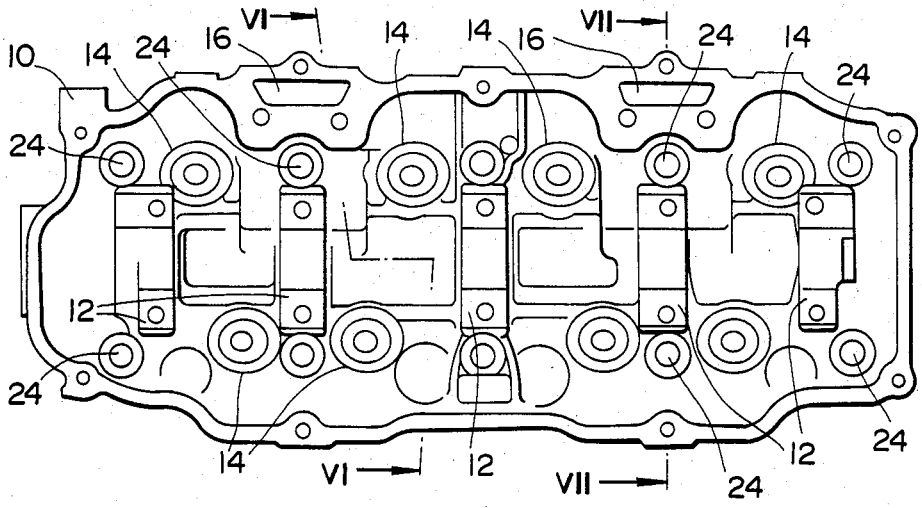
FIG. 3 is a top plan view of a cylinder head embodying the present invention.

Turning now to FIGS. 3 to 9 a cylinder head according to a first embodiment of the present invention is shown. As shown, the cylinder head 10 is formed with a series of rocker shaft bearings 12, spring seats 14 and vapor outlet ports 16 through which gaseous coolant is discharged. The cylinder head 10 further includes exhaust ports 17 formed in the side thereof, bores 18 for receiving spark plugs and two liquid coolant inlet ports 20. The cylinder head is also formed with cavities 22 which cooperate with cylinders formed in the cylinder block 23 to define variable volume combustion chambers, elongate bores 24 through which head bolts are disposed and a structure defining an essentially discrete coolant jacket 26 therein.

Figure 5:
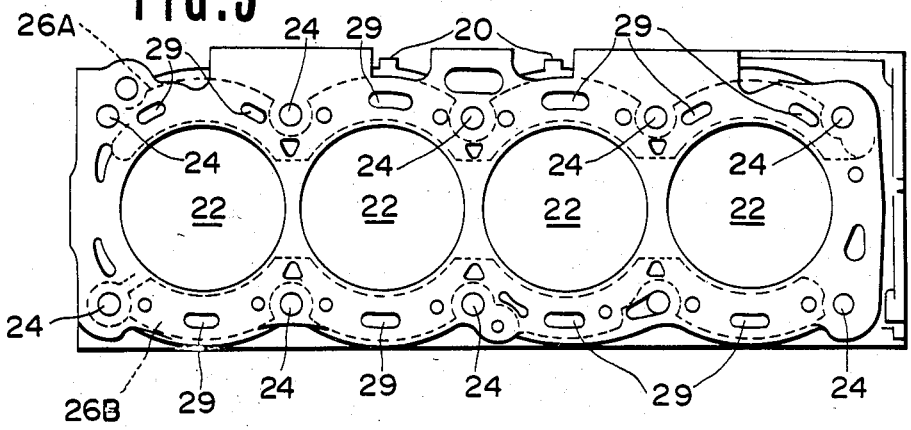
FIG. 5 is a bottom plan view of the cylinder head shown in FIGS. 3 and 4.
Figure 9:
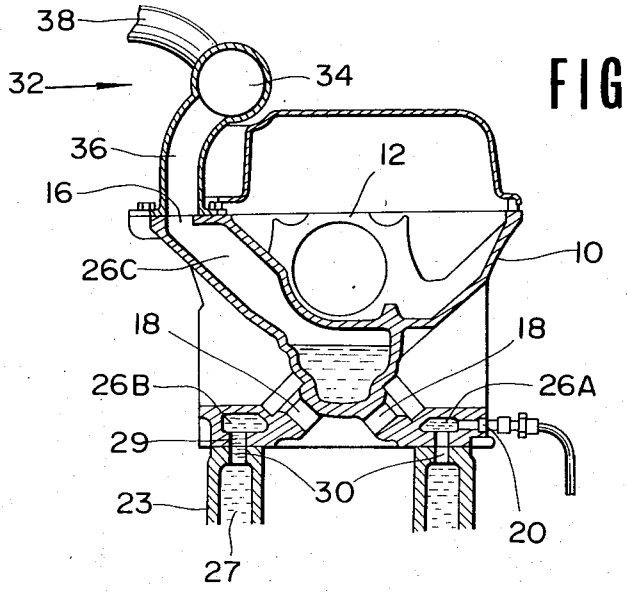
FIG. 9 is a sectional elevation showing the cylinder head of FIGS. 3–5 and the vapor manifold of FIG. 8 assembled together and mounted on a cylinder block.

First and second sections 26A and 26B of this coolant jacket, as shown in broken line in FIG. 5, extend along either side of the cylinder head 10 in proximity of the combustion chamber defining cavities 22. Fluid communication between these two sections and the essentially discrete coolant jacket 27 formed in the cylinder block 23 is established by ports 29. These ports 29 as shown in FIG. 9 cooperate with corresponding ports 30 formed in the upper deck of the cylinder block 28.

Figure 6:
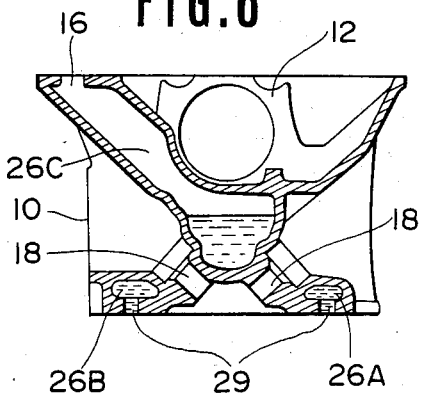
FIG. 6 is a sectional view taken along section line VI—VI of FIG. 3.

Third sections 26C of the coolant jacket 26 which are in fluid communication with the first and second sections 28A and 28B, extend from a "chamber-like" section (no numeral) located above the combustion chamber and spark plug receiving bores 18 (see FIGS. 6 and 7) upwardly to each of the vapor outlet ports 16 (see FIG. 6). In the embodiment shown in FIGS. 3 to 9, each two adjacent sections 26C extend upwardly and toward each other to merge just below a vapor outlet port 16. The ports 16 are arranged to have a cross section smaller than that of the sections 26C to limit the discharge of liquid coolant from the coolant jacket.

Figure 7:
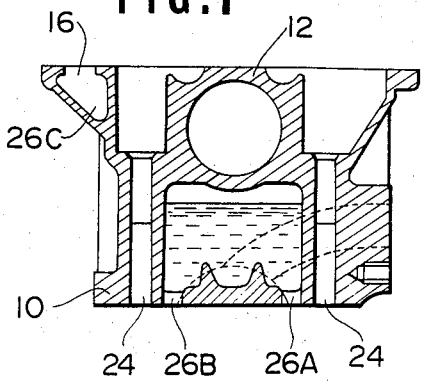
FIG. 7 is a sectional view taken along section line VII—VII of FIG. 3.

As shown in FIGS. 6 and 7, the level of coolant is maintained in the "chamber-like" chamber by the provision of a level sensor (not shown) at a level adequate to maintain the cylinder head structure subject to high head flux (viz., combustion chambers, exhaust ports and valves) totally immersed. The inclination of the "passage-like" sections 26C will be understood by taking into considered the nature of the section which results when the cylinder head is sectioned along section line VI—VI shown in FIG. 3.

Figure 4:
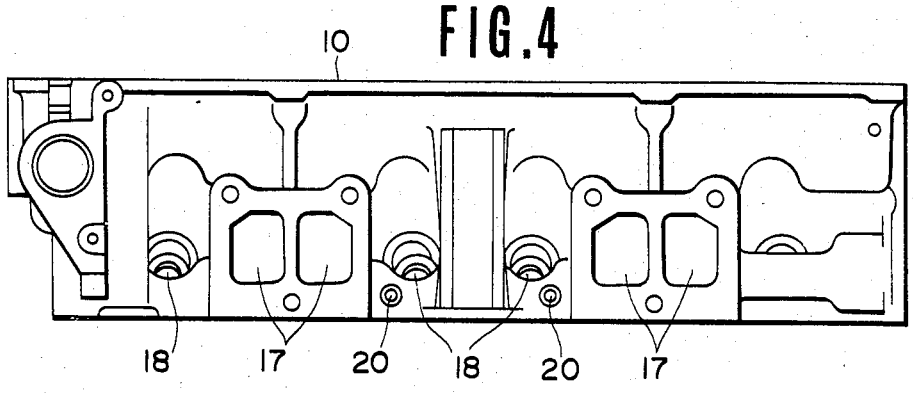
FIG. 4 is a side elevation of the cylinder head shown in FIG. 3.

As shown in FIG. 4, the liquid coolant inlet ports 20 are formed in close proximity of the lower deck of the cylinder head 10 and inboard of the exhaust ports 17 so as to supply cool liquid coolant into the "exhaust port side" or first section 26A of the coolant jacket 26. This of course ensures that the interior of especially the first section 26A (which is subject to a high heat flux due to its location adjacent the exhaust valve and ports) remains wet under all operating conditions and further tends to "pour cold coolant" on any boiling froth being produced in that zone.

Figure 8:
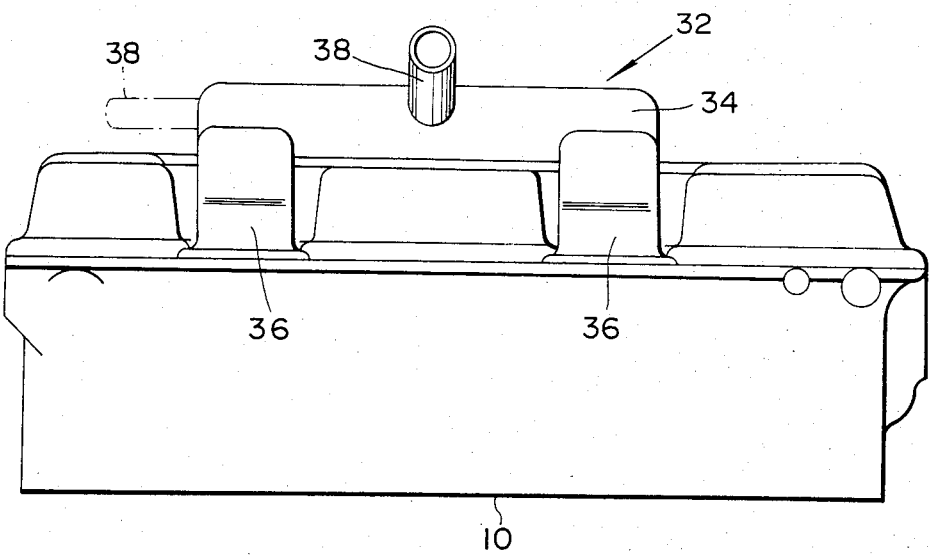
FIG. 8 shows a vapor manifold which finds advantageous application with the cylinder head structure according the present invention.

FIGS. 8 and 9 show a manifold 32 which may be advantageously used with the cylinder block according to the present invention. As shown, this manifold 32 includes an elongate reservoir section 34 and branch runners 36. As will be appreciated, as the gaseous coolant passes up through the branch runners 36 some condensation of the gaseous coolant is apt to occur. The reservoir section 34 is arranged to have an internal volume which is notably greater than that of the branch runners 36 so that upon entering the reservoir section 34 of the manifold, any droplets of coolant which might have been carried thus far, tend to slow down, precipitate out and run back down toward the cylinder head. This effect is promoted by the fact that the fluid flow undergoes at least one 90 degree change in flow direction before reaching the outlet 38 of the manifold whereby the inertia of the condensed coolant induces the aforementioned precipitation. The outlet 38 has a small cross section which is smaller than that of the reservoir section 34. It should be noted that the outlet 38 may be arranged as shown in phantom in FIG. 8.

The provision of the reservoir section 32 additionally reduces the pressure build up in the cylinder head coolant jacket in a manner to attenuate the undesirable "boil over" which preceeds "dry spot" formation and subsequent knocking.

Figure 10:
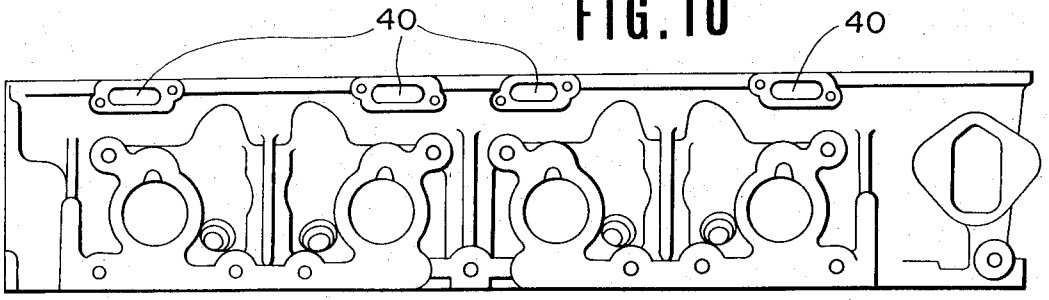
FIG. 10 shows a top plan view of a cylinder head according to a second embodiment of the present invention.

FIG. 10 shows an embodiment of the present invention wherein four vapor exhaust ports 40 are formed. In this instance a manifold having four branch runners is used.

What is claimed is:

1. In an internal combustion engine a cylinder block including a first coolant jacket into which coolant is introduced in liquid form and discharged in gaseous form;

a cylinder head removably attached to said cylinder block, said cylinder head including a structure which defines one or more combustion chambers and a second coolant jacket, said second coolant jacket including:

a first port which fluidly communicates with said first coolant jacket;

a chamber defined above the structure defining said one or more combustion chambers and said first port, said chamber being arranged to be filled with liquid coolant to a level which immerses said one or more combustion chamber defining structure;

a plurality of second ports which fluidly communicate with said chamber and through which gaseous coolant is discharged, said second ports being arranged at a level above said chamber and arranged to have a cross section which limits the discharge of liquid coolant from said chamber; and a vapor manifold mounted on said cylinder head and in fluid communication with said second ports, said vapor manifold including branch runners which each lead from a second port to a reservoir section which has an internal volume larger than said branch runners and which is located at a level above that of said second ports, said branch runners and reservoir section being arranged to cause the fluid flowing from said second ports into said manifold to reduce speed and undergo at least one sharp change in flow direction before reaching the outlet of said manifold, said outlet being arranged to have a cross sectional area less than that of said reservoir section.

2. An internal combustion engine as claimed in claim 1, wherein said second coolant jacket defining structure includes first, second and a plurality of third sections which fluidly communicate with said chamber, said first and second sections extending along either side of said cylinder head at levels lower than that at which said coolant is maintained, said third sections extending upwardly from said chamber and toward each other so as to merge below a second port.

3. An internal combustion engine as claimed in claim 2, further comprising a third port via which liquid coolant is introduced into said second coolant jacket, said third port being arranged to communicate said first section.

4. An internal combustion engine as claimed in claim 3, wherein said first section is formed in a portion of said cylinder head which is subject to a high heat flux.

5. An internal combustion engine as claimed in claim 1, wherein said second coolant jacket defines first, second and a plurality of third sections which fluidly communicate with said chamber, said first and second sections extending along either side of said cylinder head at levels lower than that at which said coolant is maintained, said third sections each extending upwardly from said chamber to communicate with a second port.

* * * * *